US008199078B2

(12) United States Patent
Handa et al.

(10) Patent No.: US 8,199,078 B2
(45) Date of Patent: Jun. 12, 2012

(54) IMAGE PICKUP APPARATUS AND METHOD OF DRIVING THE SAME

(75) Inventors: Tomoaki Handa, Tokyo (JP); Tetsuro Yamamoto, Kanagawa (JP); Yuuki Seo, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 429 days.

(21) Appl. No.: 12/458,117

(22) Filed: Jul. 1, 2009

(65) Prior Publication Data

US 2010/0033510 A1 Feb. 11, 2010

(30) Foreign Application Priority Data

Aug. 5, 2008 (JP) ..... 2008-201728

(51) Int. Cl.
*G09G 3/30* (2006.01)

(52) U.S. Cl. ..... 345/76; 345/204

(58) Field of Classification Search ..... 345/55, 345/89–100, 204–215, 690
See application file for complete search history.

(56) References Cited

U.S. PATENT DOCUMENTS

| | | | | |
|---|---|---|---|---|
| 7,948,456 | B2 * | 5/2011 | Yamashita et al. | 345/82 |
| 7,995,013 | B2 * | 8/2011 | Mitomi et al. | 345/82 |
| 2005/0057580 | A1 * | 3/2005 | Yamano et al. | 345/690 |
| 2005/0237281 | A1 * | 10/2005 | Tam | 345/76 |
| 2008/0218454 | A1 * | 9/2008 | Mitomi et al. | 345/76 |

FOREIGN PATENT DOCUMENTS

| | | |
|---|---|---|
| JP | 2006-330138 A | 12/2006 |
| JP | 2007-133284 | 5/2007 |
| JP | 2007-310311 | 11/2007 |
| JP | 2008-033066 A | 2/2008 |

OTHER PUBLICATIONS

Japanese Office Action issued Jun. 1, 2010 for corresponding Japanese Application No. 2008-201728.

* cited by examiner

*Primary Examiner* — Vijay Shankar
(74) *Attorney, Agent, or Firm* — Rader Fishman & Grauer, PLLC

(57) ABSTRACT

A display apparatus includes: a display area formed by disposing pixel circuits in a matrix; a signal line drive circuit for generating drive signals for signal lines in accordance with image data, and outputting the drive signals for the signal lines to signal lines of the display area, respectively; and a scanning line drive circuit for outputting write signals to scanning lines for write of the display area, respectively; wherein when there is no change in the image data, the scanning line drive circuit stops the write signals from being outputted.

8 Claims, 11 Drawing Sheets

IMAGE PICKUP APPARATUS AND METHOD OF DRIVING THE SAME

BACKGROUND OF THE INVENTION

1. Field of the Invention

The present invention relates to an image display apparatus and a method of driving the same. Also, the present invention, for example, can be applied to an electronic still camera having an active matrix type image display portion using an organic Electro Luminescence (EL) element. Also, the present invention makes it possible to reduce power consumption as compared with the existing case by stopping the control for a write transistor made in accordance with a write signal when there is no change in image data.

2. Description of the Related Art

Heretofore, an electronic still camera, a video camera or the like functions as an image display apparatus to enhance a usability for a user. That is to say, the electronic still camera acquires moving image data from an image pickup element, and displays an image corresponding to the moving image data thus acquired on an image display portion. As a result, the electronic still camera makes it possible to confirm an object of image-capturing based on the moving image, thereby enhancing the usability for the user.

In addition, when a shutter button is manipulated by the user, the electronic still camera temporarily holds image data obtained from the image pickup element in a memory, and acquires the image-capturing results based on a still image. The electronic still camera displays an image corresponding to the image data temporarily held in the memory on the image display portion. As a result, the electronic still camera makes it possible to confirm the image-capturing results right after the photographing, thereby enhancing the usability for the user.

In recent years, with regard to this sort of image display apparatus, an active matrix type image display apparatus using an organic EL element has been actively developed. Here, the image display apparatus using the organic EL element is an image display apparatus utilizing a luminous phenomenon of an organic thin film which emits a light by applying thereto an electric field. The organic EL element can be driven by applying thereto a voltage of 10 V or less. Therefore, in this sort of image display device, the power consumption can be reduced. In addition, the organic EL element is a self light emitting element. Therefore, in this sort of image display apparatus, the weight saving and the thinning can be carried out because no backlight device is demanded. Moreover, the organic EL element has the feature that its response speed is high, that is, about several microseconds. Therefore, this sort of image display apparatus has the feature that a residual image is hardly generated in a phase of display of the moving image.

Specifically, in the active matrix type image display apparatus using the organic EL element, pixel circuits each composed of an organic EL element and a drive circuit for driving the organic EL element are disposed in a matrix, thereby forming a display portion. In the image display apparatus, a signal line drive circuit and a scanning line drive circuit are disposed in the circumference of the display portion. The signal line drive circuit drives the pixel circuits in accordance with image data successively inputted thereto through respective signal lines provided in the display portion. Also, the scanning line drive circuit drives the pixel circuits through respective scanning lines provided in the display portion.

Heretofore, with regard to the image display apparatus using the organic EL element, a method of configuring a pixel circuit using two transistors is disclosed in Japanese Patent Laid-Open No. 2007-310311 (hereinafter referred to as Patent Document 1). Therefore, according to the method disclosed in Patent Document 1, the configuration can be simplified. In addition, Patent Document 1 discloses a circuit configuration with which there are corrected the dispersion of threshold voltages, and the dispersion of mobilities in drive transistors for driving the respective organic EL elements. Therefore, according to the circuit configuration disclosed in Patent Document 1, it is possible to prevent image quality from being deteriorated due to the dispersion of the threshold voltages, and the dispersion of the mobilities in the drive transistors.

In addition, Japanese Patent Laid-Open No. 2007-133284 (hereinafter referred to as Patent Document 2) proposes a circuit configuration with which processing for correcting the dispersion of the threshold voltages of the drive transistors is exerted in multiple batches. According to the circuit configuration disclosed in Patent Document 2, even when a time allocated to gradation setting for a pixel circuit is shortened due to high precision promotion, the sufficient time can be allocated to the correction for the dispersion of the threshold voltages. Therefore, even in the case of the high precision promotion, it is possible to prevent the deterioration of the image quality due to the dispersion of the threshold voltages.

SUMMARY OF THE INVENTION

Now, in this sort of display apparatus, reduction in power consumption is demanded. That is to say, when the display apparatus, for example, is applied to operation appliance such as an electronic still camera, the reduction in power consumption makes it possible to increase a used time for a battery. Moreover, a shape of the battery can be miniaturized.

The present embodiment has been made in consideration of the respects described above, and it is therefore desirable to provide a display apparatus in which power consumption can be reduced as compared with the case of an existing display apparatus, and a method of driving the same.

In order to attain the desire described above, according to an embodiment of the present invention, there is provided a display apparatus including: a display area formed by disposing pixel circuits in a matrix; a signal line drive circuit for generating drive signals for signal lines in accordance with image data, and outputting the drive signals for the signal lines to signal lines of the display area, respectively; and a scanning line drive circuit for outputting write signals to scanning lines for write of the display area, respectively; in which when there is no change in the image data, the scanning line drive circuit stops the write signals from being outputted.

According to another embodiment of the present invention, there is provided a display apparatus, including: a display area formed by disposing pixel circuits in a matrix; a signal line drive circuit for processing image data to generate drive signals for signal lines, and outputting the drive signals for the signal lines to the signal lines of the display area, respectively; and a scanning line drive circuit for outputting drive signals for a power source, and write signals to scanning lines for the power source, and scanning lines for write of the display area, respectively; each of the pixel circuits including at least: a light emitting element; a drive transistor for driving the light emitting element by using a drive current corresponding to a gate-to-source voltage; a hold capacitor for holding the gate-to-source voltage; and a sampling transistor for setting a voltage at one terminal of the hold capacitor at a voltage of corresponding one of the drive signals for the signal lines; in which a light emission time period for which the light emitting element is allowed to emit a light, and a non-light emission time period for which the light emission of the light emitting element is stopped are alternatively repeated; for the non-light emission time period, in accordance with control for the sampling transistor made in accordance with corresponding one of the write signals, a voltage developed across terminals of the hold capacitor is set at a voltage corresponding one of the drive signals for the signal lines, and an emission luminance of the light emitting element for the subsequent light emission time period is set; and when there is no change in image data, the scanning line drive circuit stops the control for the sampling transistor made in accordance with corresponding one of the write signals, and holds the sampling transistor in an OFF state.

With the constitution of the embodiment or another embodiment, when there is no change in image data, the control for the sampling transistor made in accordance with the corresponding one of the write signals is stopped, and the sampling transistor is held in the OFF state. In this case, when there is no need for changing the gradation of the emission luminance, it is possible to stop the processing for setting the gradation of the light emitting element. Therefore, it is possible to reduce the power consumption concerned with the setting of the gradation of the light emitting element, and it is also possible to reduce the power consumption of the entire display apparatus.

According to still another embodiment of the present invention, there is provided a method of driving a display apparatus having: a display area formed by disposing pixel circuits in a matrix; a signal line drive circuit for generating drive signals for signal lines in accordance with image data, and outputting the drive signals for the signal lines to signal lines of the display area, respectively; and a scanning line drive circuit for outputting write signals to scanning lines for write of the display area, respectively; in which when there is no change in image data, the scanning line drive circuit stops write signals from being outputted.

According to the present embodiment, the power consumption can be reduced as compared with the case of the existing display apparatus.

DETAILED DESCRIPTION OF THE PREFERRED EMBODIMENTS

The preferred embodiments of the present invention will be described in detail hereinafter with reference to the accompanying drawings. It is noted that the description will now be given in the following order.

1. First embodiment (control made in accordance with write signal)
2. Second embodiment (control made in accordance with write signal and signal line drive signal)
3. Changes

First Embodiment

Entire Configuration

Figure 1:
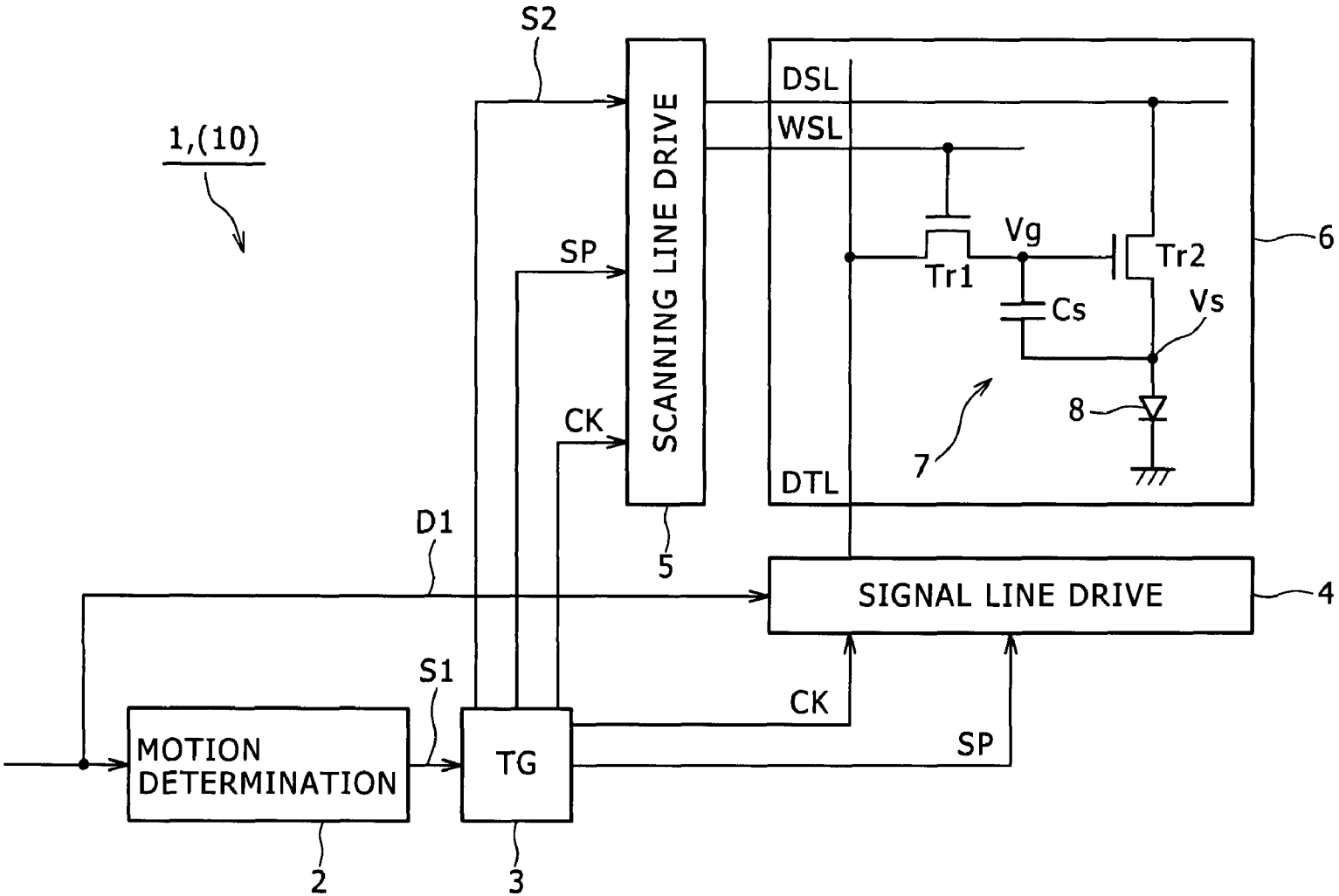
FIG. 1 is a block diagram, partly in circuit, showing a configuration of an electronic still camera according to a first embodiment of the present invention.

FIG. 1 is a block diagram, partly in circuit, showing an image display portion which is applied to an electronic still camera according to a first embodiment of the present invention. When an operation mode of the electronic still camera 1 of the first embodiment is set as a camera mode, the electronic still camera 1 acquires moving image data having a high resolution by using an image pickup element, reduces the resolution on the moving image data, and inputs image data D1 to an image display portion 10. In addition, in response to a manipulation made by a user, the electronic still camera 1 records the moving image data having the high resolution in a predetermined recording medium, thereby recording and holding the results of capturing the moving image. In addition, when the user manipulates a shutter button, the electronic still camera 1 acquires image data having a high resolution obtained from the image pickup element to temporarily store the image data thus acquired in a memory, reduces the resolution on the image data, and inputs the resulting image data D1 to the image display portion 10. When in this state, the user instructs the electronic still camera 1 to record the image capturing results, the electronic still camera 1 records the image data having the high resolution held in the memory in the recording medium, thereby recording and holding the results of capturing a still image. In addition, when the user instructs the electronic still camera 1 to monitor the image capturing results, the electronic still camera 1 records the image data on the still image and the moving image in order from the recording medium, and inputs the resulting image data D1 to the image display portion 10. Therefore, in the first embodiment, in response to the manipulation made by the user, the image data D1 on the moving image and the still image is inputted to the image display portion 10.

In the image display portion 10, a motion determining portion 2 receives as it input the image data D1, and outputs motion determination results in predetermined blocks. Here, in the first embodiment, the motion determining portion 2 is configured by utilizing a configuration of an encoder for data-compressing image data. Thus, the motion determining portion 2 determines each of sizes (lengths) of motion vectors which are successively detected in macro-blocks of the image data D1, and determines whether or not an image concerned is a moving image every field of the image data D1. It is noted that any of various determination methods can be generally applied to this motion determination. For example, a sum of absolute values of interfield difference values of corresponding pixel values may be determined based on a threshold value.

A timing generator (TG) 3 generates and outputs a sampling pulse SP and a clock signal CK necessary for each of operations of a signal line drive circuit 4 and a scanning line drive circuit 5. In addition, the timing generator 3 outputs a control signal S2 in accordance with which the operation of the scanning line drive circuit 5 is controlled based on the determination result from the motion determining portion 2. Specifically, when a current field of the image data D1 shows a moving image with respect to a last field, the timing generator 3 sets the control signal S2 as being enable, and sets the operation of the scanning line drive circuit 5 as an operation in a phase of display of the moving image. On the other hand, when the current field of the image data D1 shows a still image with respect to the last field, the timing generator 3 sets the control signal S2 as being disable, and sets the operation of the scanning line drive circuit 5 as an operation in a phase of display of the still image. It is noted that the motion determining portion 2 and the timing generator 3 are mounted and held on a control board of the electronic still camera 1.

The signal line drive circuit 4 and the scanning line drive circuit 5 drive a pixel circuit 7 provided in the display portion 6 through a signal line DTL, and scanning lines DSL and WSL, so that the image data D1 is displayed in the form of an image corresponding to thereto on the display portion 6.

Configuration of Display Portion

Figure 2:
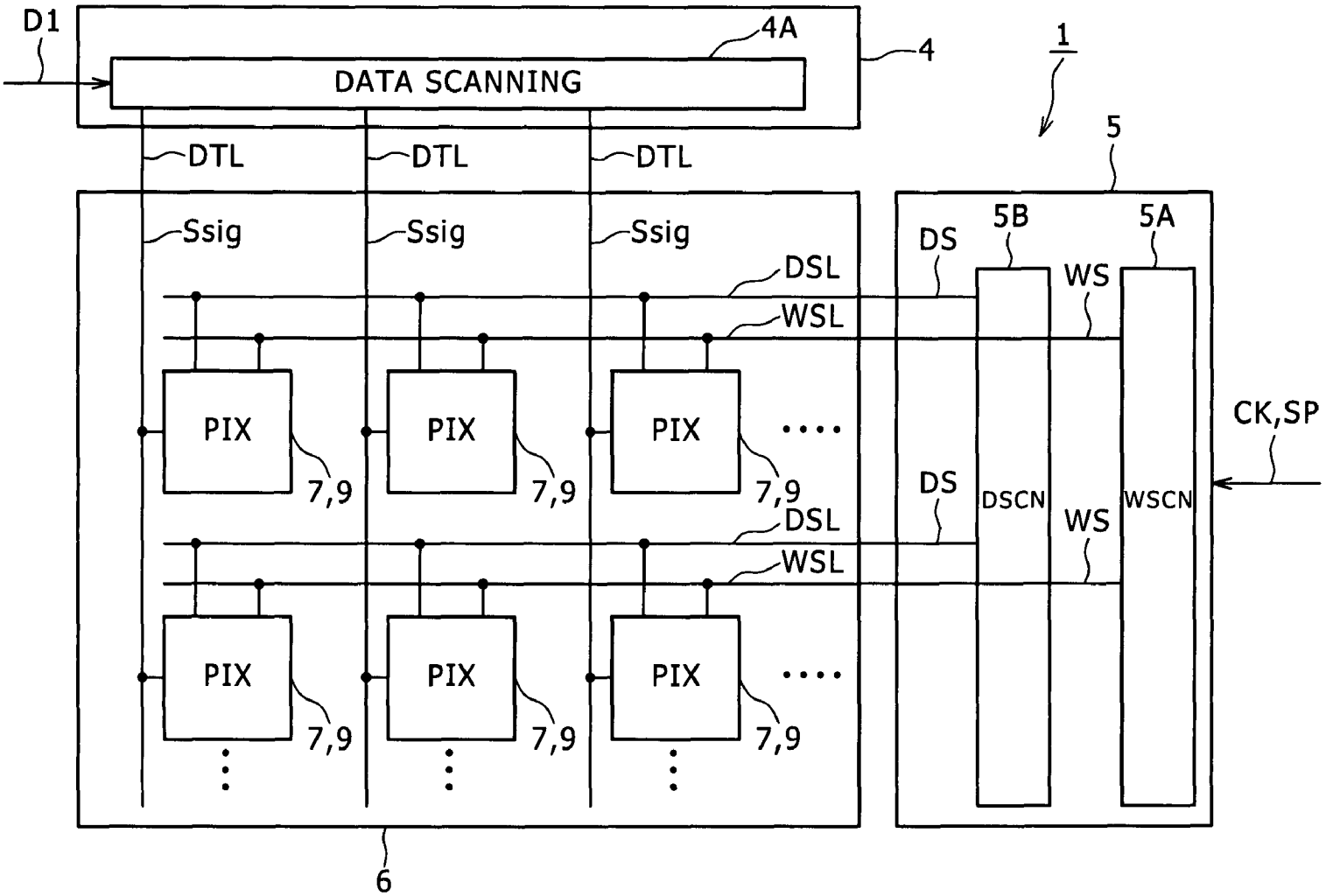
FIG. 2 is a block diagram showing a configuration of a display portion of the electronic still camera shown in FIG. 1 together with a peripheral configuration of the electronic still camera shown in FIG. 1.

FIG. 2 is a block diagram showing the display portion 6 together with the signal line drive circuit 4 and the scanning line drive circuit 5. The display portion 6 is formed on an insulating substrate such as a glass substrate, and the signal line drive circuit 4 and the scanning line drive circuit 5 are disposed in the circumference of the display portion 6.

Here, the display portion 6 is formed by disposing the pixel circuits 7 in a matrix, and a pixel (PIX) 9 is composed of an organic EL element provided in each of the pixel circuits 7. It is noted that in the image display apparatus for displaying thereon a color image, one pixel is composed of a plurality of sub-pixels for a red color, a green color and a blue color. Thus, in the case of the image display apparatus for displaying thereon a color image, the pixel circuit 7 for the red color, the pixel circuit 7 for the green color, and the pixel circuit 7 for the blue color compose the sub-pixels of the red color, the green color and the blue color, respectively. In this case, the pixel circuits 7 each three of which corresponds to the red color, the green color and the blue color, respectively, are disposed in order, thereby configuring the display portion 6.

The signal line drive circuit 4 outputs drive signals $S_{sig}$ for signal lines to signal lines DTL provided in the display portion 6, respectively. More specifically, after a data scanning circuit 4A of the signal line drive circuit 4 successively latches the image data D1 inputted thereto in the raster scanning order and allocates the image data D1 to the signal lines DTL, respectively, the data scanning circuit 4A of the signal line drive circuit 4 subjects the image data D1 thus allocated to digital-to-analog conversion processing. The signal line drive circuit 4 processes the digital-to-analog conversion results to generate the drive signals $S_{sig}$ for the respective signal lines DTL.

The scanning line drive circuit 5 outputs write signals WS, and drive signals DS for a power source to scanning lines WSL for the write signals, and scanning lines DSL for the power source, respectively, which are provided in the display portion 6. Here, the write signals WS are signals in accordance with which write transistors provided in the respective pixel circuits 7 are turned ON/OFF. In addition, the drive signals DS for the power source are signals in accordance with which drain voltages of drive transistors provided in the respective pixel circuits 7 are controlled. The scanning line drive circuit 5 processes a predetermined sampling pulse SP in accordance with a clock signal CK to generate the write signals WS and the drive signals DS in a write scanning circuit (WSCN) 5A and a drive scanning circuit (DSCN) 5B, respectively.

Basic Configuration of Pixel Circuit

Figure 3:
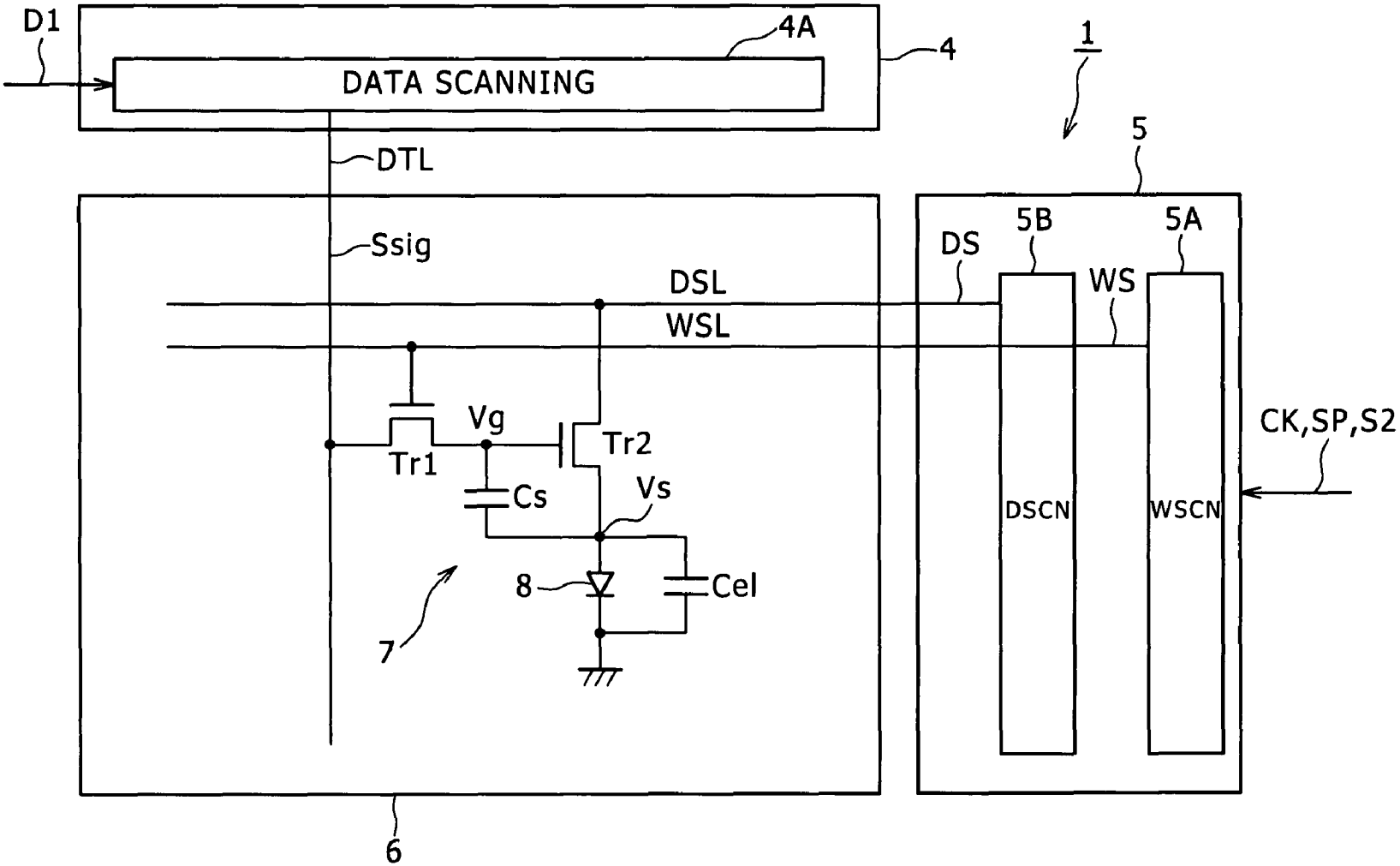
FIG. 3 is a circuit diagram, partly in block, showing a connection relationship in a pixel circuit of the display portion shown in FIG. 2.

FIG. 3 is a circuit diagram, partly in block, showing a detailed configuration of the pixel circuit 7. In the pixel circuit 7, a voltage of a cathode electrode of an organic EL element 8 is set at a predetermined negative side voltage, and in the case shown in FIG. 3, the predetermined negative side voltage is set at a voltage of an earth line. In the pixel circuit 7, an anode electrode of the organic EL element 8 is connected to a source electrode of a drive transistor Tr2. It is noted that the drive transistor Tr2 is an N-channel transistor, for example, configured in the form of a Thin Film Transistor (TFT). In the pixel circuit 7, a drain electrode of the drive transistor Tr2 is connected to the scanning line DSL for the power source, and the drive signal DS for the power source is supplied from the scanning line drive circuit 5 to the scanning line DSL for the power source. With the configuration described above, the pixel circuit 7 current-drives the organic EL element 8 by using the drive transistor Tr2 configured in the form of a source follower. It should be noted that in FIG. 3, a capacitance $C_{el}$ is a floating capacitance of the organic EL element 8.

In the pixel circuit 7, a hold capacitor $C_s$ for holding therein a gate-to-source voltage $V_{gs}$ of the drive transistor Tr2 is provided between gate electrode and the source electrode of the drive transistor Tr2. Also, a gate side edge voltage of the hold capacitor $C_s$ is set at the voltage of the drive signal $S_{sig}$ in accordance with the write signal WS. As a result, in the pixel circuit 7, the drive transistor Tr2 current-drives the organic EL element 8 in accordance with the gate-to-source voltage $V_{gs}$ corresponding to the drive signal $S_{sig}$.

That is to say, in the pixel circuit 7, the gate electrode of the drive transistor Tr2 is connected to the signal line DTL through the write transistor Tr1 which operates so as to be turned ON/OFF in accordance with the write signal WS. Here, it should be noted that the write transistor Tr1 is an N-channel transistor, for example, configured in the form of a TFT.

FIGS. 4A to 4E are respectively time charts explaining a basic operation of the pixel circuit 7. In the pixel circuit 7, for a time period for which the drive signal DS for the power source is caused to rise to a power source voltage $V_{cc}$, the drive transistor Tr2 drives the organic EL element 8 (refer to FIG. 8). Therefore, the time period for which the drive signal DS for the power source is caused to rise to the power source voltage $V_{cc}$ is a light emission time period for which the organic EL element 8 emits a light.

Figures 4A, 4B, 4C, 4D, 4E:
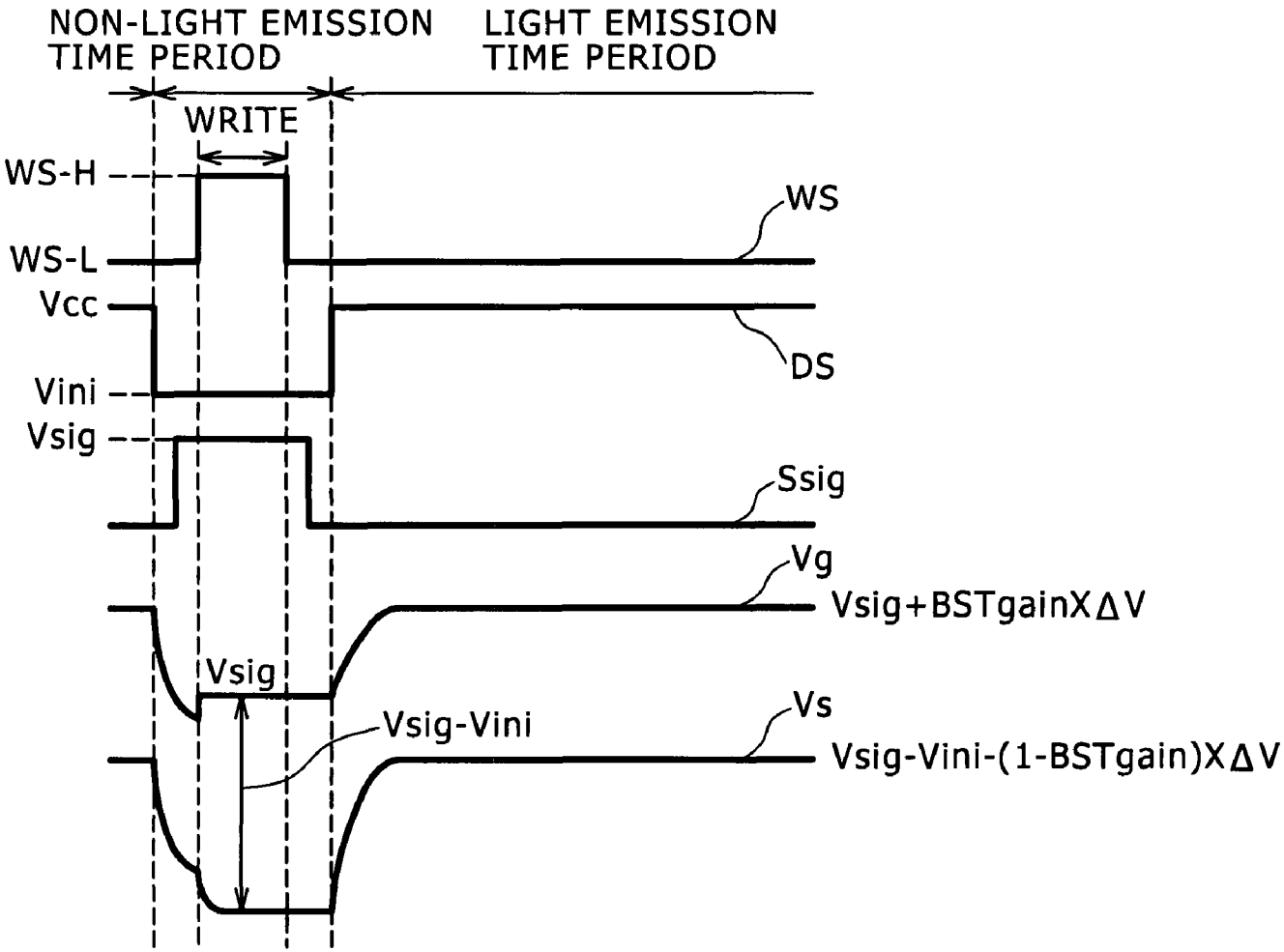
FIGS. 4A to 4E are respectively signal waveform charts explaining an operation of the pixel circuit shown in FIG. 3.
Figure 5:
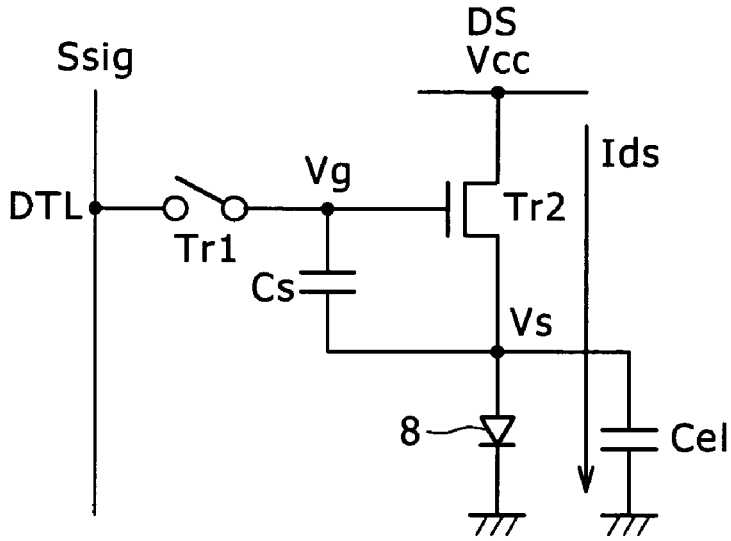
FIG. 5 is a circuit diagram explaining the operation of the pixel circuit shown in FIG. 3.

For the light emission time period, in the pixel circuit 7, the write transistor Tr1 is held in an OFF state in accordance with the write signal WS (refer to FIG. 4A). As a result, in the pixel circuit 7, for the light emission time period, as shown in FIG. 5, the organic EL element 8 is caused to emit a light by using a drive current $I_{ds}$ corresponding to the gate-to-source voltage $V_{gs}$ (refer to FIGS. 4D and 4E) of the drive transistor Tr2 as the voltage developed across the opposite terminals of the hold capacitor $C_s$. Note that, here, the drive current $I_{ds}$ is expressed by Expression (1):

$$I_{ds}=(1/2)\cdot\mu\cdot(W/L)\cdot C_{ox}\cdot(V_{gs}-V_{th})^2 \quad (1)$$

where $V_{th}$ is a threshold voltage of the drive transistor Tr2, μ is a mobility of the drive transistor Tr2, W is a channel width of the drive transistor Tr2, L is a channel length of the drive transistor Tr2, $C_{ox}$ is a capacitance of an gate insulating film per unit area of the drive transistor Tr2.

In the pixel circuit 7, when the drive signal DS for a power source is caused to drop to a fixed voltage $V_{ini}$, power supply from the power source to the drive transistor Tr2 is stopped. Therefore, a time period for which the drive signal DS for the power source is caused to drop to the fixed voltage $V_{ini}$ is a non-light emission time period for which the organic EL element 8 is stopped from emitting a light. Here, the fixed voltage $V_{ini}$ is a voltage which is low enough to cause a drain of the drive transistor Tr2 to function as a source thereof, and is a voltage which is lower than a cathode voltage of the organic EL element 8.

Figure 6:
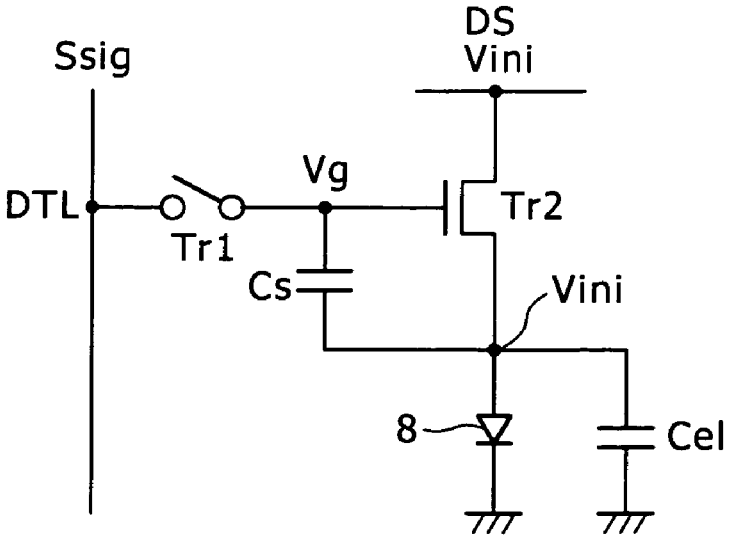
FIG. 6 is a circuit diagram explaining an operation of the pixel circuit shown in FIG. 3 next to the operation shown in FIG. 5.

That is to say, in the pixel circuit 7, when the non-light emission time period starts, the drive signal DS for the power source drops to the fixed voltage $V_{ini}$, whereby the electrode charges accumulated in the floating capacitance $C_{el}$ held in the source side edge of the drive transistor Tr2 flow into the scanning line DSL. As a result, in the pixel circuit 7, as shown in FIG. 6, a source voltage $V_s$ of the drive transistor Tr2 drops to approximately the fixed voltage $V_{ini}$, so that the organic EL element 8 stops from emitting a light (refer to FIG. 4E). In addition, a gate voltage $V_g$ of the drive transistor Tr2 drops in conjunction with the drop of the source voltage $V_s$ of the drive transistor Tr2 (refer to FIG. 4D).

Figure 7:
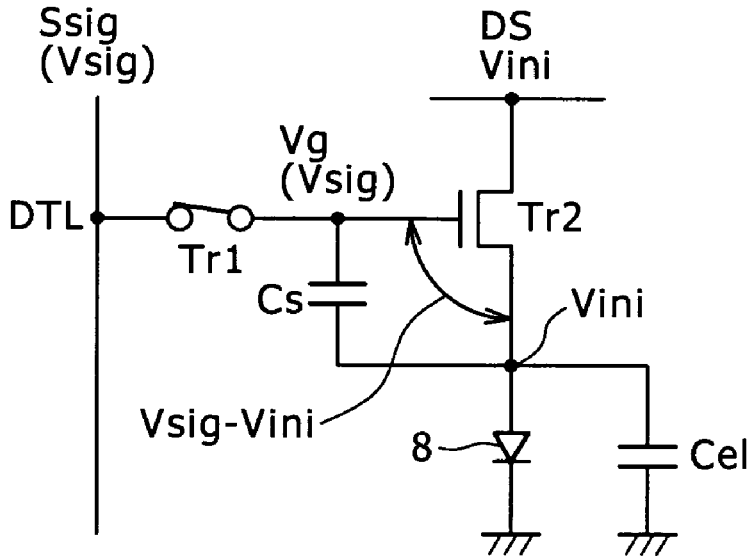
FIG. 7 is a circuit diagram explaining an operation of the pixel circuit shown in FIG. 3 next to the operation shown in FIG. 6.

In the pixel circuit 7, for the non-light emission time period, subsequently, the scanning line drive circuit 5 sets the voltage of the signal line DTL at a gradation setting voltage $V_{sig}$ indicating an emission luminance of the organic EL element 8 (refer to FIG. 4C). Also, the write transistor Tr1 is held in an ON state in accordance with the write signal WS (refer to FIG. 4A). As a result, in the pixel circuit 7, as shown in FIG. 7, the voltage developed across the opposite terminals of the hold capacitor $C_s$ is set at a voltage ($V_{gs}-V_{ini}$) corresponding to the gradation setting voltage $V_{sig}$, and the emission luminance of the organic EL element 8 for the subsequent light emission time period is set.

Figure 8:
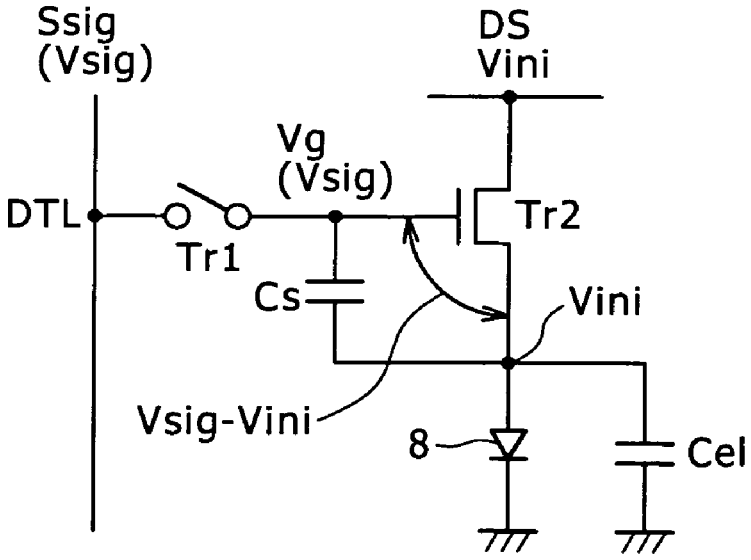
FIG. 8 is a circuit diagram explaining an operation of the pixel circuit shown in FIG. 3 next to the operation shown in FIG. 7.
Figure 9:
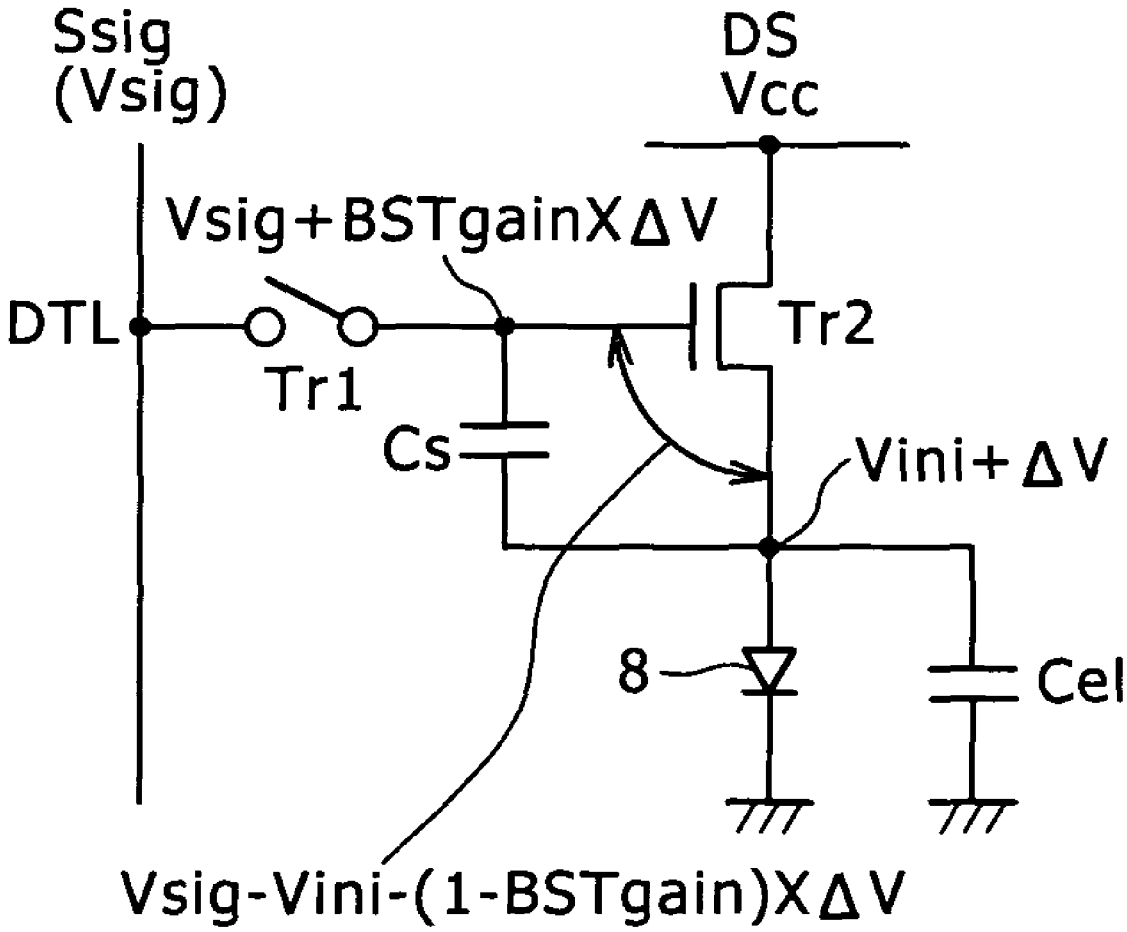
FIG. 9 is a circuit diagram explaining an operation of the pixel circuit shown in FIG. 3 next to the operation shown in FIG. 8.

Subsequently, in the pixel circuit 7, as shown in FIG. 8, the write transistor Tr1 is set in an OFF state in accordance with the write signal WS. After that, as shown in FIG. 9, the drive signal DS for the power source is caused to rise to the power source voltage $V_{cc}$, so that the light emission time period starts. Note that, in the pixel circuit 7, when the light emission time period starts, the gate voltage $V_g$ and source voltage $V_s$ of the drive transistor Tr2 rise by an operation of a so-called bootstrap circuit, $(1-BST_{gain})\times\Delta V$ and $BST_{gain}\times\Delta V$ shown in FIG. 9 represent an amount of source voltage $V_s$ changed, and an amount of gate voltage $V_g$ changed by the operation of the bootstrap circuit, respectively.

Concrete Configuration of Pixel Circuit

Now, each of the write transistor Tr1 and the drive transistor Tr2 composing the pixel circuit 7 is configured in the form of a TFT. In this case, the TFTs have a disadvantage that the dispersion of the threshold voltages $V_{th}$ and mobilities μ thereof are both large. In the pixel circuit 7, as shown in Expression (1), the dispersion of the threshold voltages $V_{th}$ and mobilities μ lead to the dispersion of the drive currents $I_{ds}$ for the gate-to-source voltage $V_{gs}$. As a result, in the display portion 6, the emission luminances of the pixel circuits 7 disperse, thereby remarkably deteriorating the image quality.

In order to cope with the above situation, the pixel circuit 7, as shown in FIGS. 10A to 10F in contrast with FIG. 3, executes processing for correcting the dispersions of the threshold voltages $V_{th}$ and the mobilities μ.

Figures 10A, 10B, 10C, 10D, 10E, 10F:
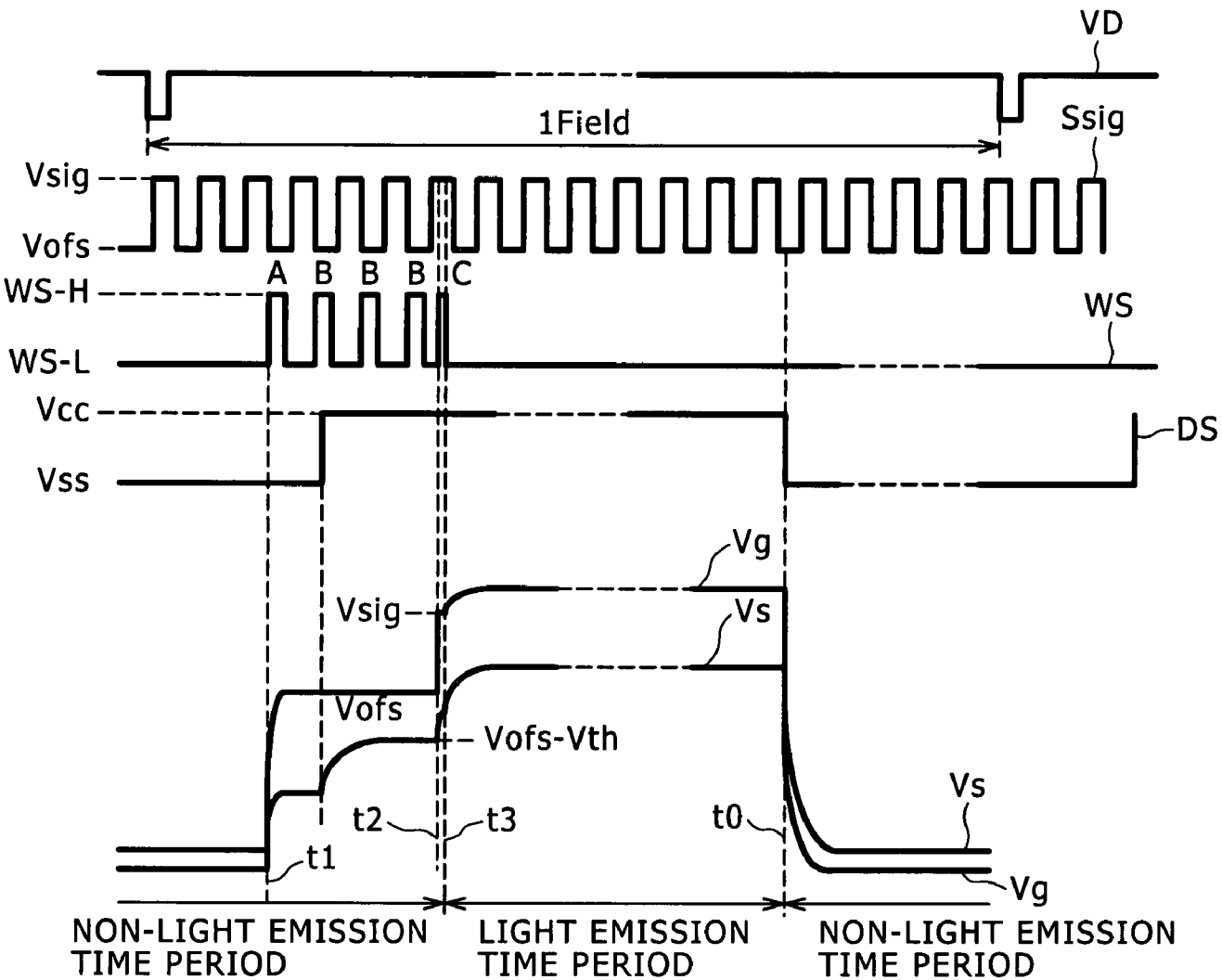
FIGS. 10A to 10F are respectively signal waveform charts explaining processing for correcting dispersions of threshold voltages and mobilities of drive transistors in contrast with FIG. 3.

That is to say, with the configuration shown in FIGS. 10A to 10F, the signal line drive circuit 4 successively outputs the gradation setting voltages $V_{sig}$ for the respective pixel circuits 7 connected to the respective signal lines DTL so as to hold a voltage $V_{ofs}$ for correction of the threshold voltage $V_{th}$ between each adjacent two gradation setting voltage $V_{sig}$ (refer to FIG. 10B). Here, it is noted that the fixed voltage $V_{ofs}$ for correction for the threshold voltage $V_{th}$ is a fixed voltage used for correction for the dispersion of the threshold voltages $V_{th}$ of the drive transistor Tr2. In addition, the gradation setting voltage $V_{sig}$ is a voltage representing the emission luminance of the organic EL element 8, and is a voltage obtained by adding the fixed voltage $V_{ofs}$ for correction for the threshold voltage $V_{th}$ to a gradation voltage $V_{in}$. Also, the gradation voltage $V_{in}$ is a voltage corresponding to the emission luminance of the organic EL element 8. The image data D1 allocated to the respective signal lines DTL is subjected to the digital-to-analog conversion processing, thereby generating the gradation voltage Vin every signal line DTL. It is noted that reference symbol VD (refer to FIG. 10A) designates a vertical synchronous signal.

In the pixel circuit 7, when the non-light emission time period starts at a time point t0, the drive signal DS for the power source is caused to drop to a predetermined fixed voltage $V_{ss}$ (refer to FIG. 10D). Here, the predetermined fixed voltage $V_{ss}$ is a voltage which is low enough to cause a drain of the drive transistor Tr2 to function as a source thereof, and is a voltage which is lower than a cathode voltage of the organic EL element 8.

As a result, in the pixel circuit 7, the electric charges accumulated in the floating capacitance $C_{el}$ held in the source side edge of the drive transistor Tr2 flows into the scanning line DSL through the drive transistor Tr2. As a result, the source voltage $V_s$ of the drive transistor Tr2 drops to approximately the voltage $V_{ss}$ (refer to FIG. 10F). In addition, a gate voltage $V_g$ of the drive transistor Tr2 drops in conjunction with the drop of the source voltage $V_s$ of the drive transistor Tr2 (refer to FIG. 10E).

After that, in the pixel circuit 7, at a time point t1 at which the voltage of the signal line DTL is set at the fixed voltage $V_{ofs}$, the write transistor Tr1 is turned ON in accordance with the write signal WS (refer to FIG. 10C), and the voltage at the gate side edge of the hold capacitor $C_s$ is set at the fixed voltage $V_{ofs}$. As a result, in the pixel circuit 7, the gate-to-source voltage $V_{gs}$ of the drive transistor Tr2 is set at approximately a voltage ($V_{ofs}-V_{ss}$). Here, in the pixel circuit 7, the setting of the fixed voltages $V_{ofs}$ and $V_{ss}$ results in that the voltage ($V_{ofs}-V_{ss}$) is set at a larger voltage than the threshold voltage $V_{th}$ of the drive transistor Tr2.

Subsequently, in the pixel circuit 7, for a time period for which the drive signal DS for the power source is caused to rise to the power source $V_{cc}$, and the voltage of the signal line DTL is held at the fixed voltage $V_{ofs}$, the write transistor Tr1 is repetitively turned ON in accordance with the write signal WS. As a result, in the pixel circuit 7, in a state in which the gate voltage $V_g$ of the drive transistor Tr2 is held at the fixed voltage $V_{ofs}$, the voltage developed across the opposite terminals of the hold capacitor $C_s$ is set at the threshold voltage $V_{th}$ of the drive transistor Tr2 by discharging the electric charges corresponding to the voltage developed across the opposite terminals of the hold capacitor $C_s$ through the drive transistor Tr2.

After that, in the pixel circuit 7, at a time point t2 at which the voltage of the signal line DTL is set at the corresponding gradation setting voltage $V_{sig}$ ($=V_{in}+V_{ofs}$), the operation state of the write transistor Tr1 is switched from the OFF state over to the ON state in accordance with the write signal WS (refer to FIG. 10C). As a result, the gate voltage $V_g$ of the drive transistor Tr2 is set at the gradation setting voltage $V_{sig}$ (refer to FIG. 10E).

As a result, in the pixel circuit 7, the gate-to-source voltage $V_g$, of the drive transistor Tr2 is set at a voltage obtained by adding the threshold voltage $V_{th}$ of the drive transistor Tr2 to the gradation voltage $V_{in}$. As a result, in the pixel circuit 7, the dispersion of the threshold voltages $V_{th}$ of the drive transistors Tr2 is effectively avoided, thereby making it possible to drive the organic EL element 8 in this state. Also, it is possible to prevent the image quality from being deteriorated due to the dispersion of the emission luminances of the organic EL elements 8.

In the pixel circuit 7, when the gate voltage $V_g$ of the drive transistor Tr2 is set at the gradation setting voltage $V_{sig}$, in a state in which the drain voltage of the drive transistor Tr2 is held in the power source voltage $V_{cc}$, the gate electrode of the drive transistor Tr2 is connected to the signal line DTL for a given time period. As a result, in the pixel circuit 7, the electric charges corresponding to the voltage developed across the opposite terminals of the hold capacitor CS are discharged by the charge current corresponding to the mobility μ of the drive transistor Tr2. Also, the dispersion of the mobilities μ of the drive transistors Tr2 is corrected in conjunction with the discharging operation.

It is noted that in FIGS. 10A to 10F, a time period for which the voltage developed across the opposite terminals of the hold capacitor $C_s$ is set at the voltage equal to or larger than the threshold voltage $V_{th}$ of the drive transistor Tr2 is designated with reference symbol A. In addition, a time period for which the voltage developed across the opposite terminals of the hold capacitor $C_s$ is set at the threshold voltage $V_{th}$ of the drive transistor Tr2 by the discharge through the drive transistor Tr2 is designated with reference symbol B. Also, a time period for which the emission luminance is set by executing the processing for correcting the mobility μ of the drive transistor Tr2 is designated with reference symbol C. It should be noted that the processing for causing the drive signal DS for the power source to rise to the power source voltage $V_{cc}$ prior to the time period A, thereby setting the voltage developed across the opposite terminals of the hold capacitor $C_s$ at the voltage equal to or larger than the threshold voltage $V_{th}$ of the drive transistor Tr2, and the processing for setting the voltage developed across the opposite terminals of the hold capacitor $C_s$ at the threshold voltage $V_{th}$ of the drive transistor Tr2 by the discharge through the drive transistor Tr2 may be executed simultaneously.

Control for Scanning Line Drive Circuit Made in Accordance with Control Signal

FIGS. 11A to 11H are respectively time charts explaining the control for the scanning line drive circuit 5 made in accordance with the control signal S2 in contrast with the time charts shown in FIGS. 10A to 10F. The signal line drive circuit 4 switches the gradation setting voltage $V_{sig}$, and the fixed voltage $V_{ofs}$ over to each other to output one of the gradation setting voltage $V_{sig}$ and the fixed voltage $V_{ofs}$ in accordance with a clock signal CK(4) for the signal line drive circuit 4 (refer to FIG. 11B), thereby outputting the drive signals $S_{sig}$ for the respective signal lines DTL (refer to FIG. 11F).

The scanning line drive circuit 5 successively transfers sampling pulses SP(DS) for the drive signal DS for the power source (refer to FIG. 11C) in accordance with the clock signal for the scanning line drive circuit 5, thereby generating an operation reference signal for the scanning lines DSL. The scanning line drive circuit 5 switches the power source voltage $V_{cc}$ and the fixed voltage $V_{ss}$ over to each other in accordance with the operation reference signal thus generated, thereby outputting drive signals DS for the power source for the respective scanning lines DSL (refer to FIG. 11G). In addition, the scanning line drive circuit 5 similarly, successively transfers sampling pulses SP(WS) for the write signal WS (refer to FIG. 11D) in accordance with the clock signal, thereby generating an operation reference signal for the scanning lines WSL.

Figures 11A, 11B, 11C, 11D, 11E, 11F, 11G, 11H:
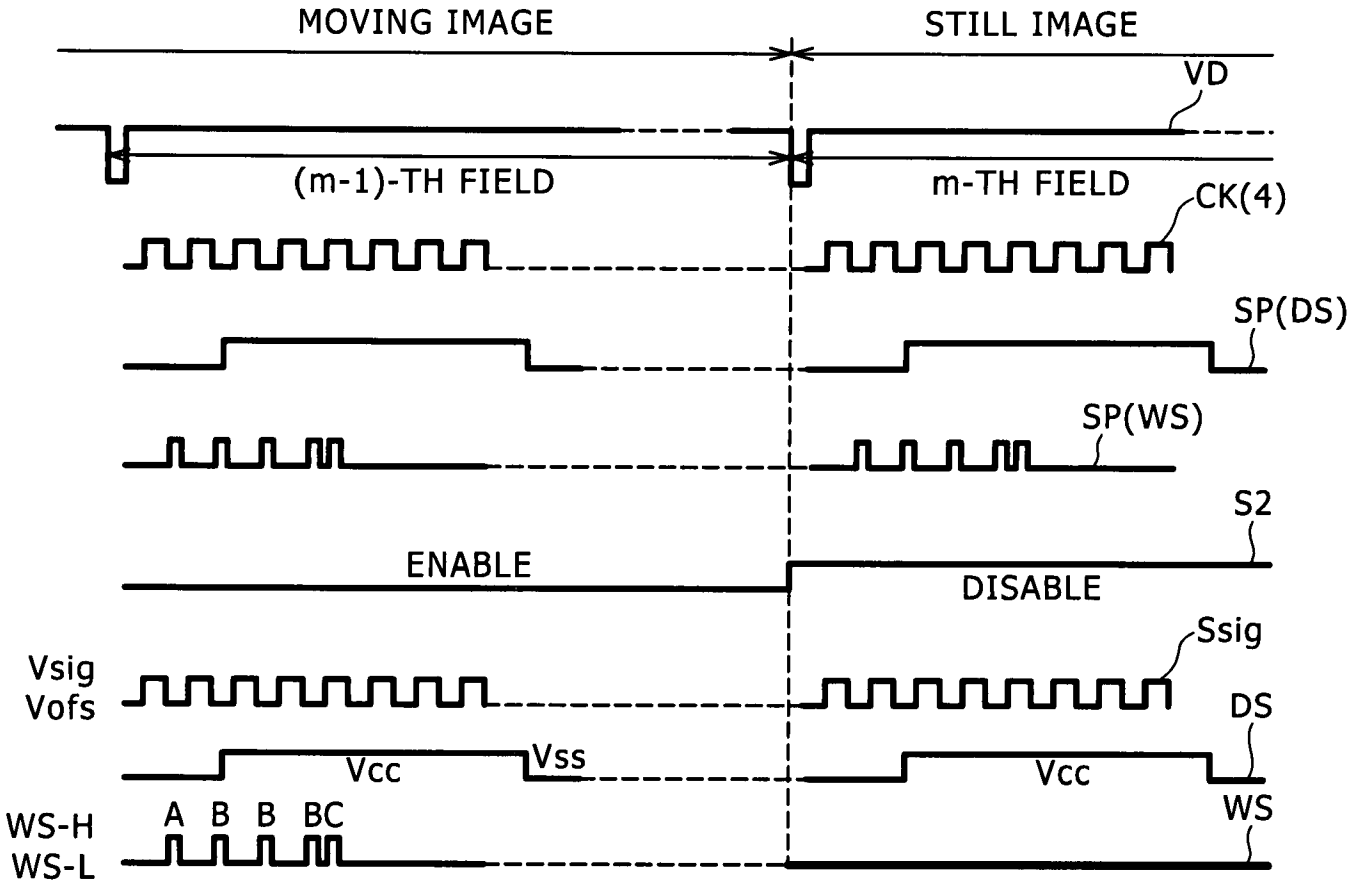
FIGS. 11A to 11H are respectively signal waveform charts explaining control for a scanning line drive circuit made in accordance with a control signal in contrast with the signal waveform charts shown in FIGS. 10A to 10F.

For a time period for which the control signal S2 is set as being enable, the scanning line drive circuit 5 sets an H level and an L level for the write signal WS in accordance with the operation reference signal for the write signal WS, thereby outputting the write signal WS (refer to FIG. 11H). As a result, when the image data D1 is the moving image data, the display portion 6 sets the gradations for the pixel circuits 7 with a field period, so that the light emission time period, and the non-light emission time period are repeated.

On the other hand, for a time period for which the control signal S2 is set as being disable, the scanning line drive circuit 5 holds the write signal WS (refer to FIG. 11H) at the L level. As a result, when the image data D1 corresponds to a still image, the display portion 6 stops the control for the write transfer Tr1, thereby holding the write transistor Tr1 in the OFF state. Also, the display portion 6 stops the gradation setting processing for the pixel circuits 7, so that the light emission time period, and the non-light emission time period are repeated.

Operation of Electronic Still Camera of First Embodiment

With the configuration described above, in the electronic still camera 1 (refer to FIGS. 1 and 2), the image data D1, on the still image and the moving image, obtained from the image pickup element and the recording medium is inputted to the signal line drive circuit 4. After being allocated to the signal lines DTLs, the image data D1 is subjected to the digital-to-analog conversion processing to be converted into the gradation voltage $V_{in}$, and the drive signals $S_{sig}$ for the respective signal lines DTL are generated in accordance with the gradation voltage $V_{in}$. In the electronic still camera 1 (refer to FIG. 3 to FIGS. 10A to 10F), the voltages developed across the opposite terminals of the hold capacitors $C_s$ provided in the respective pixel circuits 7 are set at the voltages corresponding to the respective drive signals $S_{sig}$ in accordance with the control for the respective write transistors Tr1 made in accordance with the respective write signals WS outputted from the scanning drive circuit 5. In addition, the organic EL elements 8 are driven by the respective drive transistors Tr2 based on the gate-to-source voltages corresponding to the voltages developed across the opposite terminals of the hold capacitors $C_s$. As a result, it is possible to display the image corresponding to the image data D1 on the display portion 6 of the electronic still camera 1.

However, in the case where any of the measures to meet the situation is not taken at all, in the electronic still camera 1, even when the still image having no necessity for changing the emission luminance of the organic EL element 8 is displayed on the display portion 6, the emission luminance of the organic EL element 8 is set by controlling the write transistor Tr1 with the field period. Therefore, for the control for the write transistor Tr1 when the still image is displayed, the electric power is wastefully consumed.

In order to cope with this situation, in the electronic still camera 1, the image data D1 is inputted to the motion determining portion 2, and the motion determining portion 2 determines whether or not there is the motion in fields. In addition, the timing generator 3 generates the control signal S2 in accordance with the determination results. When the still image is displayed in accordance with the control signal S2, the control for the write transistor Tr1 made in accordance with the write signal WS is stopped, and thus the write transistor Tr1 is held in the normally-OFF state. As a result, in the pixel circuits 7, the voltages developed across the opposite terminals of the hold capacitors $C_s$ which are set once are held for the time period for which the still image is displayed, and the light emission time period and the non-light emission time period are repeated for a time period for a plurality of fields, which results in that the organic EL elements 8 emit respective lights with the respective given emission luminances.

As a result, in the electronic still camera 1, the power consumption can be further reduced in this scanning line drive circuit 5 than in the case of the existing electronic still camera, which results in that it is possible to reduce the power consumption in the entire electronic still camera 1.

In addition, in the electronic still camera 1, the processing for correcting the dispersion of the threshold voltages $V_{th}$ of the drive transistors Tr2 is executed for the non-light emission time period (refer to FIGS. 10A and 10B). Specifically, in each of the pixel circuits 7, the voltage developed across the opposite terminals of the hold capacitor $C_s$ is set at the voltage equal to or larger than the threshold voltage $V_{th}$ in accordance with the control for the write transistor Tr1 made in accordance with the write signal WS. After that, the voltage developed across the opposite terminals of the hold capacitor $C_s$ is set at the threshold voltage $V_{th}$ of the drive transistor Tr2 by the discharge through the drive transistor Tr2, thereby correcting the dispersion of the threshold voltages $V_{th}$ of the drive transistors Tr2. In addition, the processing for correcting the dispersion of the mobilities μ of the drive transistor Tr2 is executed in the phase of the gradation setting (refer to FIG. 10C).

Therefore, when the control for the write transistor Tr1 made in accordance with the write signal WS is stopped in the phase of the display of the still image, the consumption of the electric power necessary for the processing for correcting the dispersion of the threshold voltages $V_{th}$ of the drive transistors Tr2, and the processing for correcting the dispersion of the mobilities μ of the drive transistors Tr2 can also be made less.

As a result, it should be noted that in each of the pixel circuit 7, when the moving image is displayed, the voltage developed across the opposite terminals of the hold capacitor $C_s$ is set at the voltage of the drive signal $S_{sig}$ in accordance with the control made for the write transistor Tr1, so that the light emission time period starts, and the non-light emission time period starts in accordance with the control for the drain voltage of the drive transistor Tr2 made in accordance with the drive signal DS for the power source. On the other hand, when the still image is displayed, the control for the write transistor TR1 made in accordance with the write signal WS is stopped, whereby the light emission time period, and the non-light emission time period start in accordance with only the control for the drain voltage of the drive transistor Tr2 made in accordance with the drive signal DS for the power source.

As a result, in the electronic still camera 1, the light emission time period is held at approximately the same length between the phase of the display of the moving image, and the phase of the display of the still image. Therefore, it is possible to prevent the unnatural difference in luminance level of the displayed picture between the case where the moving image is displayed, and the case where the still image is displayed.

Effect of First Embodiment

According to the first embodiment of the present invention, when there is no change in image data, the control for the write transistor made in accordance with the write signal is stopped, thereby making it possible to reduce the power consumption as compared with the case of the existing the electronic still camera.

Specifically, the motion determining portion configured to determine the change in image data is provided, and the control for the write transistor made in accordance with the write signal is stopped in accordance with the determination results obtained from the motion determining portion, thereby making it possible to reduce the power consumption as compared with the case of the existing the electronic still camera.

In addition, the voltage developed across the opposite terminals of the hold capacitor is set in accordance with the control made by the drive signal for the power source, and the write signal, thereby correcting the dispersion of the threshold voltages of the drive transistors. In this case, when there is no change in image data, the control made in accordance with the write signal is stopped, so that the light emission time period, and the non-light emission time period start in accordance with the drive signal for the power source. As a result, it is possible to effectively avoid the deterioration of the image quality due to the dispersion of the threshold voltages of the drive transistors, and thus it is possible to prevent the difference in luminance level between the phase of the display of the moving image, and the phase of the display of the still image.

Second Embodiment

Figure 12:
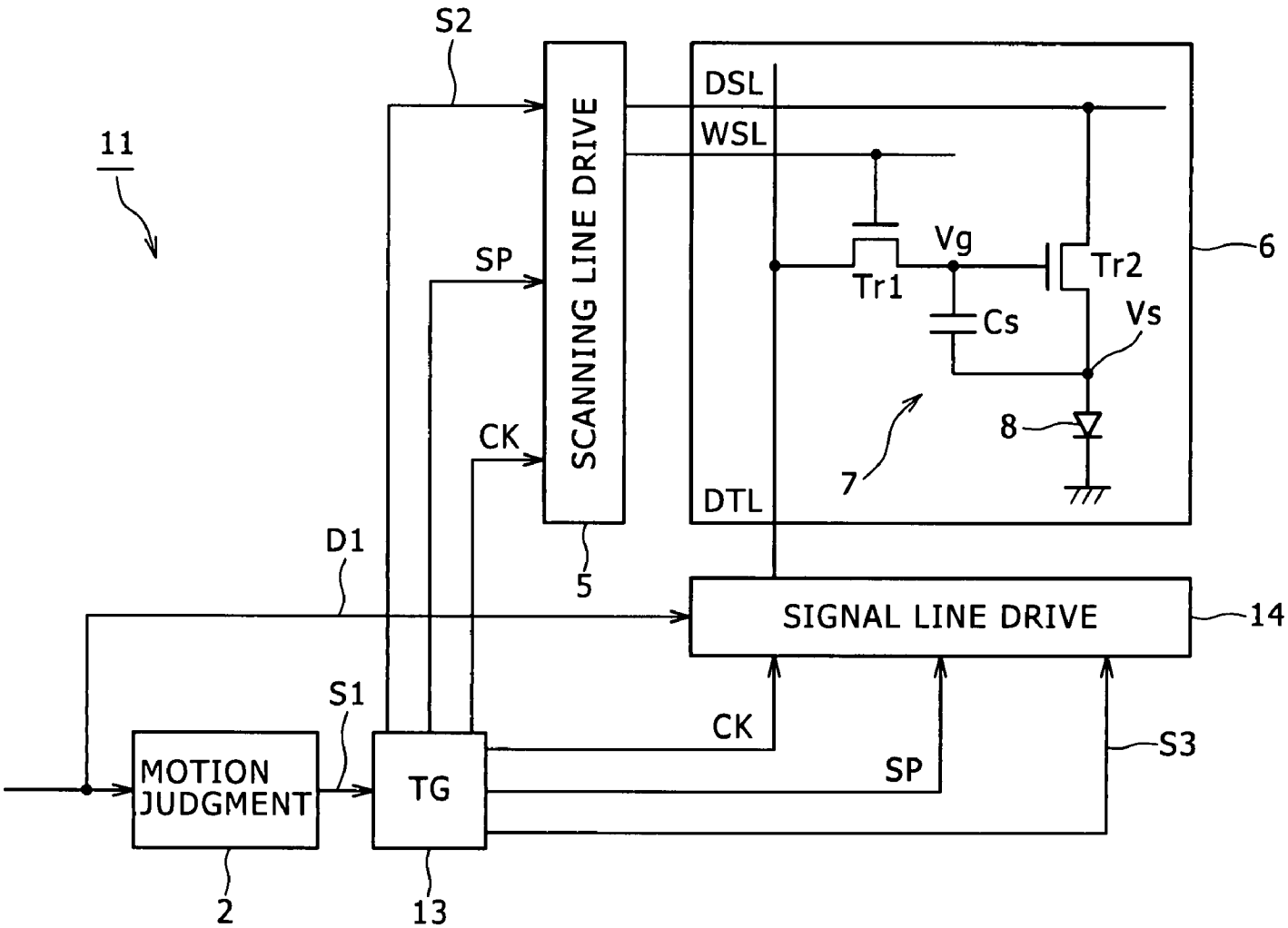
FIG. 12 is a block diagram, partly in circuit, showing a configuration of an electronic still camera according to a second embodiment of the present invention.
Figures 13A, 13B, 13C, 13D, 13E, 13F, 13G, 13H:
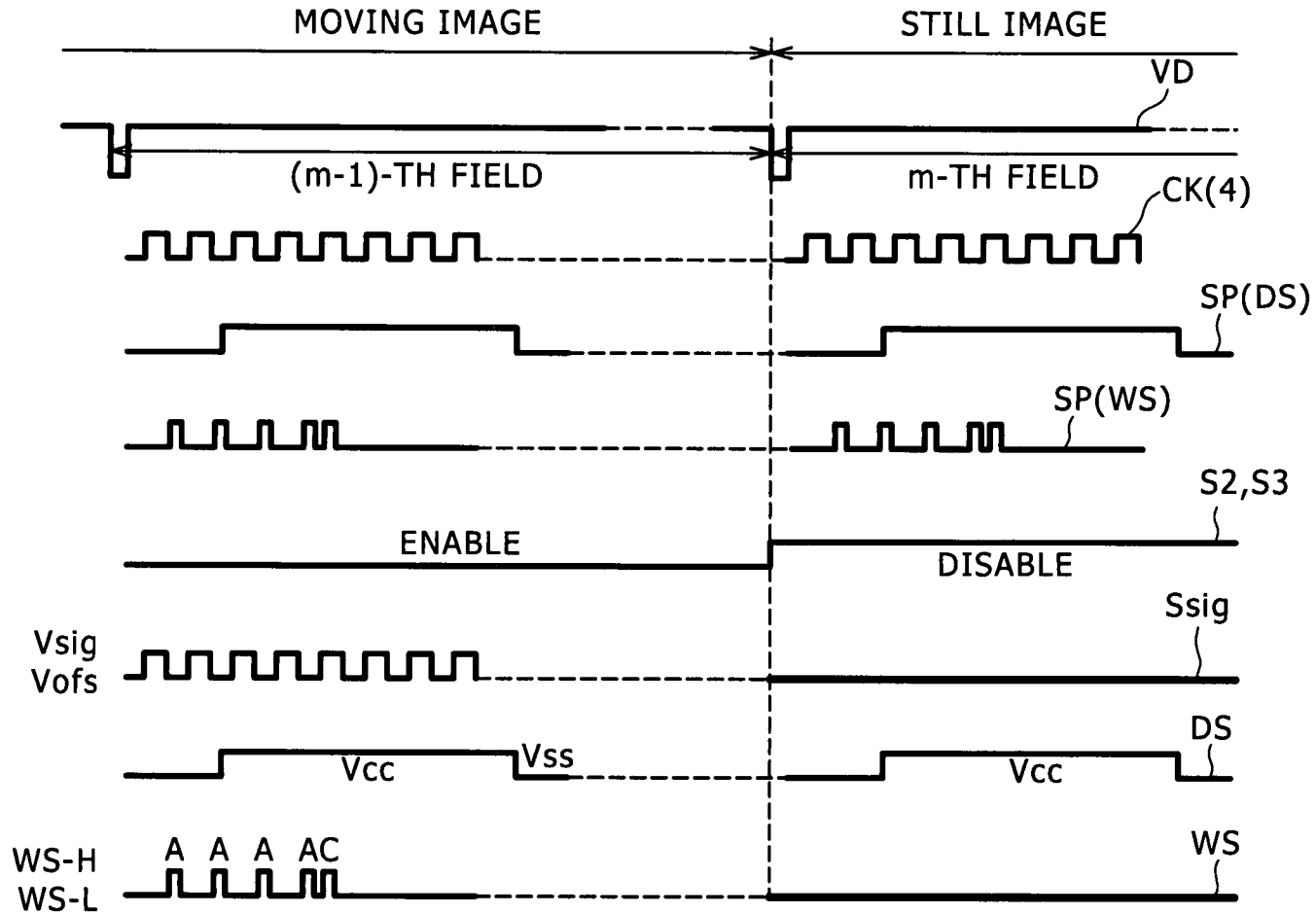
FIGS. 13A to 13H are respectively signal waveform charts explaining an operation of the electronic still camera shown in FIG. 12.

FIG. 12 is a block diagram, partly in circuit, showing a configuration of an electronic still camera according to a second embodiment of the present invention in contrast with the electronic still camera shown in FIG. 1. The electronic still camera 11 of the second embodiment is configured in the same manner as that in the electronic still camera 1 except that a timing generator 13 and a signal line drive circuit 14 are disposed instead of disposing the timing generator 3 and the signal line drive circuit 4, respectively.

The timing generator 13 is configured in the same manner as that in the timing generator 3 except that the timing generator 13 outputs a control signal S3 to the signal line drive circuit 14 in accordance with the determination results obtained from the motion determining portion 2. Specifically, when the current field of the image data D1 shows the moving image with respect to the last field, the timing generator 13 sets the control signal S3 as being enable, and sets an operation of the signal line drive circuit 14 as an operation in the phase of the display of the moving image. On the other hand, when the current field of the image data D1 shows the still image with respect to the last field, the timing generator 13 sets the control signal S3 as being disable, and sets the operation of the scanning line drive circuit 5 as an operation in a phase of the display of the still image.

As shown in FIGS. 13A to 13H in contrast with FIGS. 11A to 11H, when the control signal S3 is set as being disable, the signal line drive circuit 14 stops the processing for the image data D1, thereby stopping the signal line drive signal $S_{sig}$ from being outputted. On the other hand, when the control signal S3 is set as being enable, the signal line drive circuit 14 processes the image data D1 similarly to the case of the signal line drive circuit 4, thereby outputting the drive signal $S_{sig}$ to the signal line DTL.

In the second embodiment, when there is no change in image data, the drive signal $S_{sig}$ is further stropped from being outputted to the signal line DTL, whereby it is possible to reduce the power consumption in the signal line drive circuit 14, and it is possible to further reduce the power consumption.

Changes

It should be noted that although in the first embodiment described above, the description has been given with respect to the case where the change in image data is determined in fields, and the control for the write transistor made in accordance with the write signal is stopped in accordance with the determination results, the present invention is by no means limited thereto. That is to say, the change in image data may be determined in lines or plural lines, and the control for the write transistor made in accordance with the write signal may be stopped in accordance with the determination results.

In addition, although in each of the first and second embodiments described above, the description has been given with respect to the case where presence or absence of the change in image data is determined by processing the image data, thereby outputting the control signals, the present invention is by no means limited thereto. That is to say, these control signals may be acquired from a controller for controlling the operation for outputting the image data.

In addition, although in each of the first and second embodiments described above, the description has been given with respect to the case where as shown in FIGS. 10A to 10F, the processing or the like for correcting the threshold voltage of the drive transistor on the assumption of the basic configuration described above, the present invention is by no means limited thereto. That is to say, when the sufficient characteristics can be ensured in terms of the practical use, each of the pixel circuits may be configured based on the basic configuration described with reference to FIGS. 4A to 4E, and the light emission time period and the non-light emission time period may be alternately repeated in accordance with the control for the drain voltage of the drive transistor made in accordance with the drive signal for the power source.

In addition, although in each of the first and second embodiments described above, the description has been given with respect to the case where when the still image is displayed, on a steady basis, the control made in accordance with the write signal, and the output of the drive signal to the signal line are both stopped, the present invention is by no means limited thereto. That is to say, the control made in accordance with the write signal, and the output of the drive signal to the signal line may be carried out with a given field period. In this case, it is possible to prevent the image quality from being changed due to a leakage current, a temperature change and the like when the still image is displayed for a long time.

In addition, although in each of the first and second embodiments described above, the description has been given with respect to the case where the discharge of the electric charges corresponding to the voltage developed across the opposite terminals of the hold capacitor through the drive transistor is carried out for a plurality of time periods, the present invention is by no means limited thereto. That is to say, the present embodiment can be generally applied to the case as well where the discharge processing is executed for one time period.

In addition, although in each of the first and second embodiments described above, the description has been given with respect to the case where the N-channel transistor is applied to the drive transistor, the present invention is by no means limited thereto. That is to say, the present embodiment can be generally applied to the image display apparatus or the like in which a P-channel transistor is applied to the drive transistor.

In addition, although in each of the first and second embodiments described above, the description has been given with respect to the case where the present embodiment is applied to the image display apparatus using the organic EL element, the present invention is by no means limited thereto. That is to say, the present embodiment can be generally applied to any of the image display apparatuses having various current-driven self light emitting elements.

Also, although in each of the first and second embodiments described above, the description has been given with respect to the case where the present embodiment is applied to the electric still camera, the present invention is by no means limited thereto. That is to say, the present embodiment can be generally applied to any of various apparatuses, such as a mobile phone, each having the image display function, or any of various image display apparatuses such as a television receiver.

The present embodiment, for example, can be applied to the electronic still camera having the active matrix type image display portion using the organic EL element.

The present application contains subject matter related to that disclosed in Japanese Priority Patent Application JP 2008-201728 filed in the Japan Patent Office on Aug. 5, 2008, the entire content of which is hereby incorporated by reference.

What is claimed is:

1. A method for driving a display apparatus comprising a display area formed by disposing pixel circuits in a matrix, a signal line drive circuit for processing image data to generate drive signals respectively output to signal lines of the display area, and a scanning line drive circuit for respectively outputting write signals to scanning lines of said display area, wherein each of said pixel circuits includes a light emitting element, a drive transistor for driving said light emitting element by using a drive current, a hold capacitor, and a sampling transistor for setting a voltage at one terminal of said hold capacitor at a voltage of a corresponding one of the drive signals for the signal lines, the method comprising:

allowing the light emitting element to emit a light for a light emission time period for which said light emitting element is allowed to emit a light, and stopping the light emitting element from emitting light for a non-light emission time period, wherein the light emission time period and the non-light emission time period are alternately repeated; and setting a voltage developed across terminals of the hold capacitor at a voltage corresponding to one of the drive signals for the signal lines, said setting occurring for the non-light emission time period, in accordance with control for said sampling transistor made in accordance with a corresponding one of the write signals, wherein when there is no change in image data, said scanning line drive circuit stops the control for said sampling transistor made in accordance with a corresponding one of the write signals, and holds said sampling transistor in an OFF state.

2. The method according to claim 1, wherein said scanning drive circuit stops the write signal from being outputted in accordance with a determination result obtained from a change determining portion.

3. The method according to claim 2, wherein the determination made by said change determining portion is a determination made in fields.

4. The method according to claim 3, wherein when there is no change in the image data, said scanning line drive circuit stops the signal line drive signal from being outputted.

5. A display apparatus, comprising:

a display area formed by disposing pixel circuits in a matrix;

a signal line drive circuit for processing image data to generate drive signals for signal lines of the display area, and outputting the drive signals to said signal lines, respectively; and a scanning line drive circuit for outputting write signals, for writing of said display area, to scanning lines of said display area, respectively;

each of said pixel circuits including a light emitting element, a drive transistor for driving said light emitting element by using a drive current, a hold capacitor, and a sampling transistor for setting a voltage at one terminal of said hold capacitor at a voltage of a corresponding one of the drive signals for the signal lines, wherein a light emission time period for which said light emitting element is allowed to emit a light, and a non-light emission time period for which the light emission of said light emitting element is stopped are alternately repeated, for the non-light emission time period, in accordance with control for said sampling transistor made in accordance with a corresponding one of the write signals, a voltage developed across terminals of said hold capacitor is set at a voltage a corresponding one of the drive signals for said signal lines, and when there is no change in image data, said scanning line drive circuit stops the control for said sampling transistor made in accordance with a corresponding one of the write signals, and holds said sampling transistor in an OFF state.

6. The display apparatus according to claim 5, further comprising a change determining portion configured to determine a change in the image data, wherein said scanning drive circuit stops the write signal from being outputted in accordance with a determination result obtained from said change determining portion.

7. The display apparatus according to claim 6, wherein the determination made by said change determining portion is a determination made in fields.

8. The display apparatus according to claim 7, wherein when there is no change in the image data, said scanning line drive circuit stops the signal line drive signal from being outputted.

* * * * *